US008092108B2

(12) United States Patent
Bainbridge et al.

(10) Patent No.: US 8,092,108 B2
(45) Date of Patent: Jan. 10, 2012

(54) POROUS TIP LIQUID APPLICATOR HAVING DRAW FILL MECHANISM

(76) Inventors: Harry Bainbridge, Placentia, CA (US); Timothy S. Westrope, Long Beach, CA (US)

( * ) Notice: Subject to any disclaimer, the term of this patent is extended or adjusted under 35 U.S.C. 154(b) by 0 days.

(21) Appl. No.: 12/655,564

(22) Filed: Dec. 30, 2009

(65) Prior Publication Data

US 2011/0158738 A1 Jun. 30, 2011

(51) Int. Cl.
*B05C 17/01* (2006.01)
*B43K 5/06* (2006.01)

(52) U.S. Cl. ..... 401/171; 401/176; 401/179

(58) Field of Classification Search ..... 401/196, 401/198, 199, 202, 205, 206, 207, 171, 176, 401/177, 179, 182, 151, 230
See application file for complete search history.

(56) References Cited

U.S. PATENT DOCUMENTS 874,738 A * 12/1907 Crawford ..... 401/181
1,921,912 A * 8/1933 De Philipps ..... 401/176
2,040,999 A * 5/1936 Kelley ..... 401/177
2,148,236 A * 2/1939 Hanle ..... 401/177
2,187,160 A * 1/1940 Kohler et al. ..... 401/176
2,258,841 A * 10/1941 Biro ..... 401/194
2,939,459 A * 6/1960 Lazarte et al. ..... 604/191
4,808,022 A * 2/1989 Iizuka et al. ..... 401/176
5,888,008 A * 3/1999 Obersteller et al. ..... 401/230
6,250,832 B1 * 6/2001 Del Vecchio ..... 401/151
6,270,276 B1 * 8/2001 Virgo ..... 401/221
6,409,405 B1 * 6/2002 Eddington ..... 401/174
6,986,620 B2 * 1/2006 Abbas ..... 401/188 A
7,086,799 B1 * 8/2006 Pappageorge et al. ..... 401/206
7,338,225 B1 * 3/2008 Taylor ..... 401/13
2003/0102334 A1 * 6/2003 Usami et al. ..... 222/386
2006/0029459 A1 * 2/2006 Carroll ..... 401/206

* cited by examiner

*Primary Examiner* — David J. Walczak
*Assistant Examiner* — Jennifer C Chiang
(74) *Attorney, Agent, or Firm* — Roy A. Ekstrand

(57) ABSTRACT

A liquid applicator includes an elongated cylindrical body having an end cap within which a plunger is slidably moveable. The cylindrical body defines a bore receiving a plunger seal and piston secured to the interior end of a sliding plunger handle. The remaining end of the cylindrical body is coupled to a porous nib having a flow control valve in communication therewith. The plunger is removable from the piston and sealing plunger following the liquid filling process.

10 Claims, 3 Drawing Sheets

POROUS TIP LIQUID APPLICATOR HAVING DRAW FILL MECHANISM

FIELD OF THE INVENTION

This invention relates generally to liquid applicators and particularly to liquid applicators having a porous tip or nib used for transferring the liquid from the applicator to a surface.

BACKGROUND OF THE INVENTION

Porous tip liquid applicators such as the highly popular "felt tip marker" have enjoyed great popularity through the years. The convenience of utilizing porous tip applicators for liquids such as ink or the like have proven to be particularly advantageous in applying liquids to large areas such as bold lettering or artistic work. While a variety of such porous tip applicators have been provided for various liquids, most generally utilize an elongated body often cylindrical within which a quantity of liquid is contained. At one end of the liquid filled body, a housing often including one or more liquid baffles or other suitable fluid flow control apparatus is secured in communication with the liquid housed in the container. A porous nib often formed of a fabric wick-like material is secured within the housing and is held in communication with the liquid flowing through the baffles. The combined structure provides for the controlled wetting of the nib with the contained liquid allowing the user to write or otherwise transfer the liquid from the felt tip marker to the surface being written upon. For the most part, porous tip writing instruments such as felt tip applicators are provided to the consumer with a quantity of liquid such as ink prefilled within the body of the applicator.

U.S. Pat. No. 2,624,902 issued to Soldner sets forth a FOUNTAIN MARKING DEVICE WITH WORK OPERABLE VALVE which provides an early example of porous tip writing instruments. The device includes a generally cylindrical body having a hollow interior ink reservoir therein. One end of cylindrical body is capped with a closure and vent mechanism while the opposite end of the body is joined to a writing mechanism. The writing mechanism includes a porous material writing nib supported in a sliding attachment to a nib housing. The nib is coupled to a movable valve which is in communication with the liquid such as ink contained within the interior reservoir of the cylindrical body. In operation, the user presses the writing nib against a convenient surface such as the writing material to actuate the flow valve which in turn allows the liquid to flow from the interior reservoir of the cylindrical body to the porous nib thereby wetting the nib and facilitating the transfer or the liquid to the underlying surface. When the pressure is released, the valve closes and further flow of liquid is terminated.

U.S. Pat. No. 2,643,409 issued to Hempel et al. sets forth a FOUNTAIN MARKER which also represents early designs of porous tip writing instruments. The marker includes an elongated cylindrical body having a hollow interior and a closed end. The remaining end of the cylindrical body supports a porous writing nib and a flow valve. The valve is in communication with the interior reservoir of the cylindrical body and is operated to flow liquid to the porous nib whenever the nib is pressed against a writing surface.

U.S. Pat. No. 3,459,484 issued to Abrams sets forth a MARKING DEVICE having an elongated cylindrical body defining an interior liquid reservoir therein. The device includes a liquid fill valve at one end and a writing mechanism at the remaining end. The writing mechanism is pivotally joined to the cylindrical body. A porous writing tip is housed within the writing mechanism and includes a valve in communication with the interior of the cylindrical body.

U.S. Pat. No. 3,640,631 issued to Sotir sets forth a MARKING PEN having a container which in turn houses a liquid reservoir therein together with a marking nib extending from one end of the container. The nib functions for applying fluid such as ink to a surface. The nib is disposed in a cylindrical holder having a center bore therein with at least two shoulders therein. One shoulder forms a valve seat while a valve plunger is secured to the nib and disposed within the bore. The nib and valve plunger cooperate with the valve seat to control the flow of liquid from the interior of the marking applicator to the nib.

In a related art, U.S. Pat. No. 6,250,832 issued to Del Vecchio sets forth a FOUNTAIN PEN WITH DOUBLE RESERVOIR AND PLUNGER FOR FILLING THE PENS BY MEANS OF SUCTION in which a fountain pen includes a large capacity reservoir of ink having a piston-type valve that can be operated to fill the pen by suction. The pen further includes a small supply reservoir adjacent to the writing nib which supplies ink to the nib. A piston valve is provided in order to hermetically close and open a passage between the reservoir and the supply reservoir. The use of two reservoirs provides a reserve reservoir for the pen.

U.S. Pat. No. 5,888,008 issued to Obersteller et al. sets forth a WRITING INSTRUMENTS WITH REFILLABLE RESERVOIR having a supply chamber connected to a reserve chamber by a refilling valve. The refilling valve is actuated by a plunger which in turn is controlled by a push button formed with a self-closing membrane-type valve. The reserve chamber may be filled from a receptacle using a hollow needle. A separating valve at the end of the plunger closes before the refilling valve is opened to ensure that ink will not be forced into the ink flow regulator during the filling process.

While the foregoing described prior art devices have to some extent improved the art of liquid applicators and have in some instances enjoyed commercial success, there remains nonetheless a continuing need in the art for evermore improved application and use specific applicators.

SUMMARY OF THE INVENTION

Accordingly, it is a general object of the present invention to provide an improved porous tip liquid applicator. It is a more particular object of the present invention to provide an improved porous tip liquid applicator having a draw fill mechanism which allows the user to fill the applicator with the selected liquid rather than rely upon a prefilled liquid store within the applicator.

In accordance with the present invention, there is provided a porous tip liquid applicator comprising: a body defining opposed ends and an interior reservoir; an end cap secured to one end of the body defining a bore therethrough; a nib housing secured to the remaining end of the body having a porous nib supported therein in communication with the reservoir; a plunger moveable within the reservoir; and a plunger handle extending through the end cap bore into the reservoir, the plunger and the plunger handle including engagement means for removable engagement therebetween whereby the plunger handle removably engages the plunger to permit drawing liquid into the reservoir by drawing the plunger handle away from the nib housing toward the end cap and whereby the plunger handle may be disengaged from the plunger and removed once liquid drawing is completed.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT OF THE INVENTION

Figure 1:
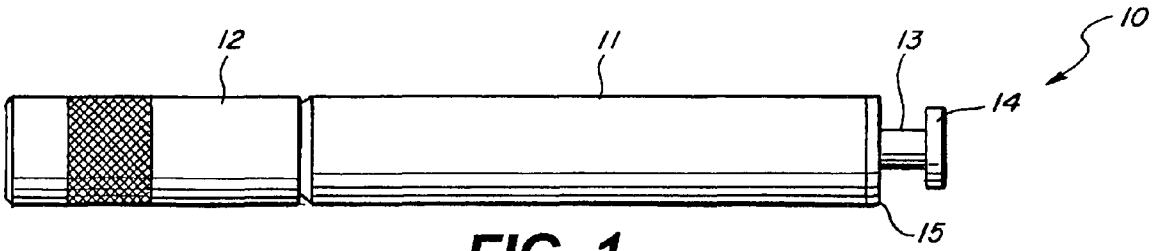
FIG. 1 sets forth a side view of a liquid applicator and protective cap constructed in accordance with the present invention.

FIG. 1 sets forth a porous liquid applicator constructed in accordance with the present invention and generally referenced by numeral 10. Applicator 10 includes an elongated generally cylindrical body 11 having an end cap 15 on one end thereof. The remaining end of cylindrical body 11 supports a nib housing 20 (seen in FIG. 2) which is secured to cylindrical body 11 in the manner described below. A protective cap 12 is shown snap-fitted to nib housing 20 to provide an air seal for applicator 10. In the configuration shown in FIG. 1, applicator 10 is generally configured in the manner in which the user would receive the applicator. Accordingly, applicator 10 includes an elongated handle 13 having an end knob 14 received within end cap 15 in its fully inserted configuration. In the preferred fabrication of the present invention, the majority of components of applicator 10 may be fabricated of molded plastic material or the like. However, it will be appreciated by those skilled in the art that a variety of materials including metal and composite materials may be utilized in fabricating the present invention liquid applicator without departing from the spirit and scope of the present invention.

Figure 2:
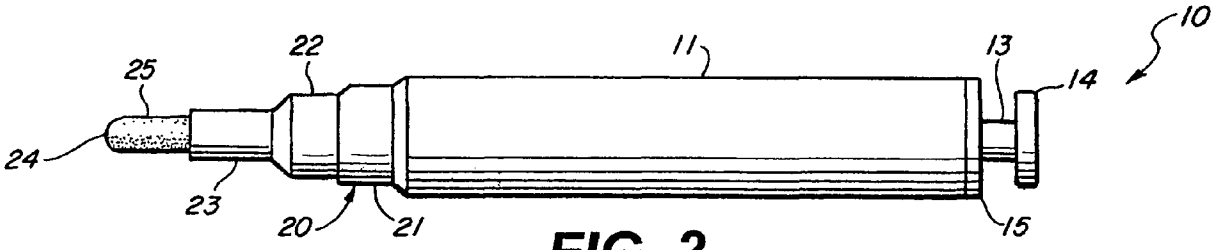
FIG. 2 sets forth a side view of the present invention liquid applicator having the protective cap removed therefrom.
Figure 3:
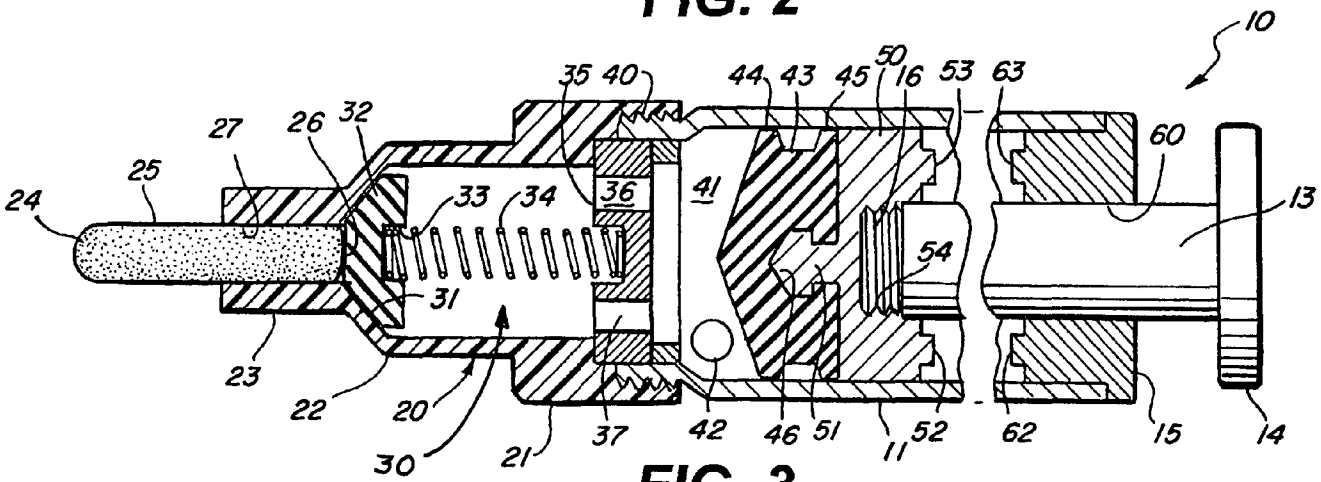
FIG. 3 sets forth a section view of the present invention liquid applicator prior to the liquid filling thereof.

FIG. 2 sets forth applicator 10 having end cap 12 removed. As described above, applicator 10 includes a generally cylindrical body 11 supporting an end cap 15 together with a nib housing 20. Nib housing 20 includes a generally cylindrical collar 21 which, as is better seen in FIG. 3, is threadably received upon cooperating threads formed in cylindrical body 11. Returning the FIG. 2, nib housing 20 further includes a valve body 22 joined to a generally cylindrical nib receiver 23. A porous nib 25 fabricated of a suitable porous wick-like material includes an applicator end 24 extending from nib receiver 23. As is better seen in FIG. 3, porous nib 25 also includes an interior end 26 received within nib receiver 23.

In the configuration shown in FIG. 2, applicator 10 having cap 12 removed therefrom is configured initially for the liquid filling process described below in greater detail. Suffice it to note here that plunger handle 13 remains fully inserted within cylindrical body 11. In the configuration of the present invention liquid applicator shown in FIGS. 1 and 2, the liquid filling process has yet to be initiated. Accordingly, the interior of the cylindrical body 11 is free of liquid material. Thus, in FIGS. 1 and 2, the present invention applicator is shown in its shipping or storage configuration.

FIG. 3 sets forth a section view of applicator 10 in the initial configuration shown in FIG. 2. Of importance to note, in examination of FIG. 3 is the relative component positions within applicator 10 prior to the initiation of the liquid filling process described below.

More specifically, Applicator 10 includes an elongated cylindrical body defining a generally cylindrical reservoir 41 therein. Applicator 10 further includes an end cap 15 received upon one end of cylindrical body 11 in a press fit sealing attachment. End cap 15 further defines a center bore 60 extending therethrough. In addition, end cap 15 further defines a pair of extending tabs 62 and 63. Applicator 10 further includes a generally cylindrical piston 50 which is fitted within the interior reservoir of cylindrical body 11. Piston 50 includes a pair of tabs 52 and 53 extending toward end cap 15. Piston 50 further includes a threaded bore 54 together with an extending attachment prong 51. A resilient plunger 43 is positioned against piston 50 and includes an attachment cavity 46 configured to receive attachment prong 51 thereby securing plunger 43 against piston 50 for movement in either direction. Plunger 43 is preferably fabricated of a resilient sealing material such as resilient plastic or rubber and defines a pair of sealing ribs 44 and 45 which cooperate with the interior surface of reservoir 41 to provide liquid seal of plunger 43.

Applicator 10 further includes an agitator ball 42 which is freely movable within reservoir 41. Cylindrical body further defines a threaded end 40. Nib housing 20 preferably fabricated of a single molded component includes a generally cylindrical collar 21 having an internal thread which engages threaded end 40 of cylindrical body 11 thereby securing nib housing 20 to body 11. Nib housing 20 includes a valve body 22 defining a valve chamber 30 therein. A spring retainer 35 defining liquid passages 36 and 37 is supported within the interior of valve chamber 30. Valve chamber 30 further defines a tapered valve seat 31. Nib house 30 further includes a nib receiver 23 defining a nib bore 27. A valve seal 32 having a generally frusto-conical body is positioned against valve seat 31. Valve seal 32 further defines a receptacle 33. A compression spring 34 is received within receptacle 33 and spring retainer 35. Valve spring 34 provides a spring force which urges valve seal 32 against valve seat 31 maintaining a valve seal which inhibits fluid flow between nib bore 27 and valve chamber 30. A porous nib 25 fabricated of a suitable porous material defines an applicator end 24 extending from nib receiver 23 and an interior end 26 positioned against valve seal 32.

Applicator 10 further includes a plunger handle 13 having an outer knob 14. Plunger handle 13 further defines a threaded end 16. As can be seen in FIG. 3, plunger handle 13 extends through bore 60 of end cap 15 and is received within threaded bore 54 of piston 50 providing a threaded engagement therebetween. Once again it will be noted that in FIGS. 1, 2 and 3 applicator 10 is shown in its initial configuration which would typically be the configuration for storage and shipment.

Figure 4:
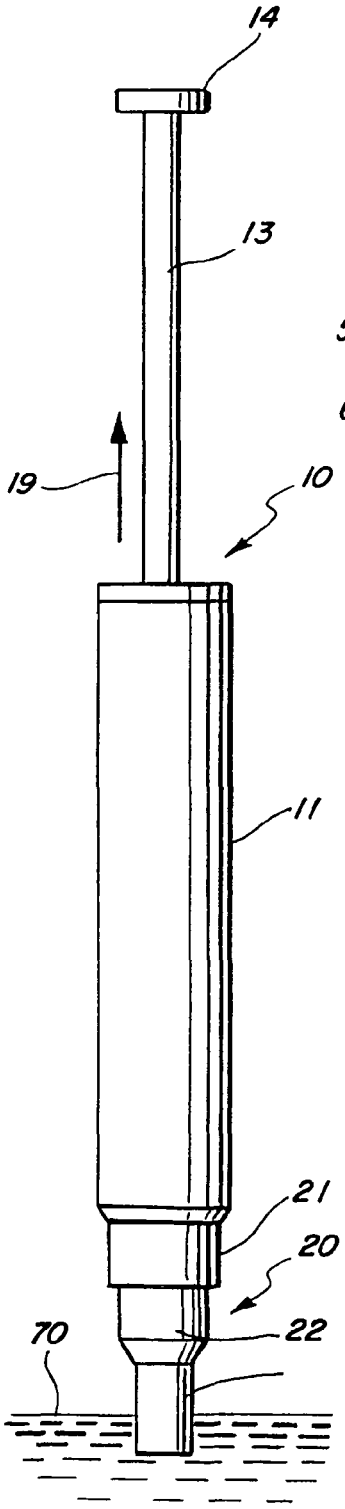
FIG. 4 sets forth an external view of the present invention liquid applicator during the liquid filling process.

FIG. 4 sets forth applicator 10 during the liquid filling process. In accordance with an important aspect of the present invention, the present invention liquid applicator may be stored and shipped in the empty configurations shown in FIGS. 1 through 3. In further accordance with an importance advantage of the present invention, applicator 10 may be filled by the user at a convenient time when the desired liquid is available. Thus, for example, in operations in which it is advantageous to provide an empty liquid applicator to be filled on site or at the point of use such as during wood staining or finishing process, the user is able to create an applicator suitable for maintaining a quantity of the on-site liquid for use at a further date. For example, in wood finishing and similar process, the stain or other liquid material utilized is often "custom mixed" to provide a desired color or other characteristic. In such circumstances, the user is able to employ the present invention liquid applicator to conveniently store a quantity of the same liquid being used in the finishing process such as a custom mixed stain or the like for further use in touchup or repair should the surface deteriorate or become damaged at a subsequent time. It is well known in the finishing art that custom mixed stains or other materials utilized in processes such as wood finishing or the like are often difficult to color match at a future date during repairs. Utilizing the present invention liquid applicator, the practitioner is able to custom mix such as stain or the like and once the suitable stain color and characteristic is obtain for application to the to-be-finished wood, the practitioner can then store a quantity of this liquid within the present invention applicator. This avoids the inherent difficulties of attempting a color match in the event modifications or repairs subsequently implemented require processes such as touching up damaged surfaces of the wood material.

It will be apparent to those skilled in the art that while the present invention liquid applicator finds particularly advantageous use in the environment of custom wood finishing and staining processes, the applicator is suitable for virtually any flowable liquid such as paint or the like in other arts and practices.

Thus in FIG. 4, applicator 10 is shown in the process of filling a quantity of a liquid such as wood stain or the like generally referenced by numeral 70. Of importance to note in FIG. 4 is the absence of porous nib 25 from nib receiver 23. Thus as described above, applicator 10 includes a cylindrical body 11 supporting an end cap 15 together with a nib housing 20. As is also described above, nib housing 20 includes a collar 21, a valve body 22 and a nib receiver 23. With temporary reference to FIG. 3, it will be recalled that nib receiver 23 defines an interior nib bore 27. Returning to FIG. 4, applicator 10 having nib 25 removed from nib receiver 23 is partially emerged within liquid 70. The fill process is initiated and completed by drawing plunger handle 13 using knob 14 from body 11 in the direction indicated by arrow 19. This drawing action of plunger 13 moves piston 50 and plunger 43 (seen in FIG. 3) upwardly through cylindrical body 11 producing a partial vacuum which draws a quantity of liquid 70 into cylindrical body 11. The cooperation of components within applicator 10 during the liquid drawing process below in FIG. 5 in greater detail. Suffice it to note here that the movement of plunger 13 in the direction of arrow 19 produces a partial vacuum within body 11 causing liquid 70 to be drawn upwardly through nib housing 20 into body 11.

Figure 5:
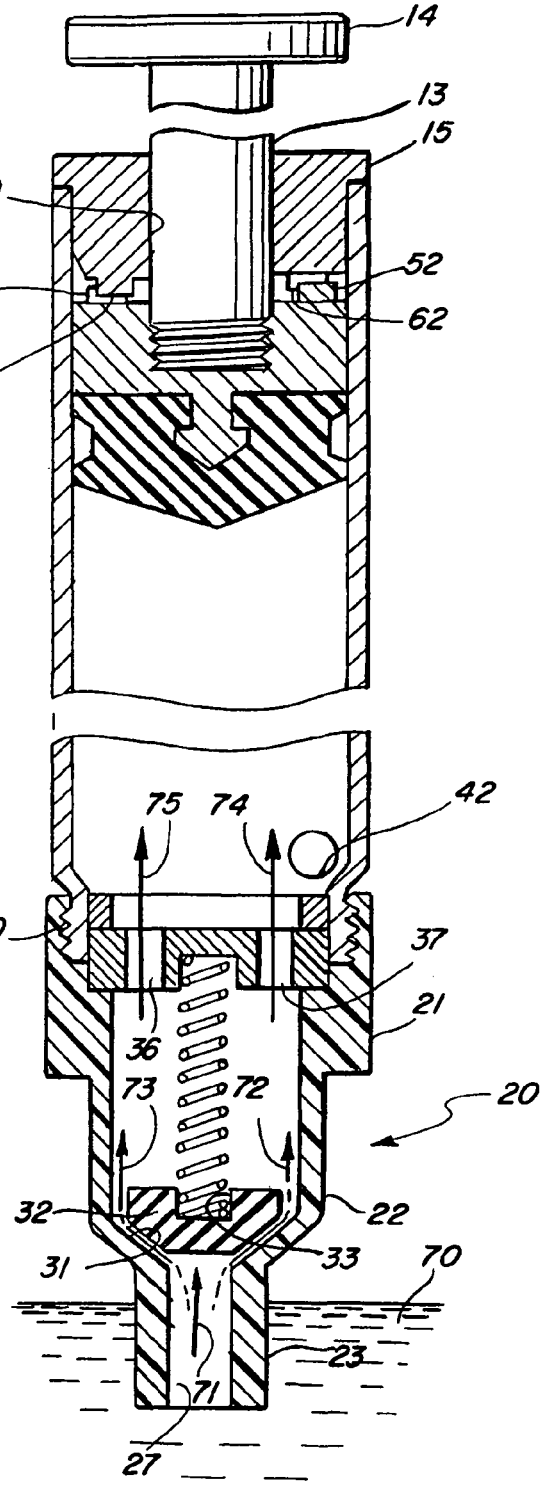
FIG. 5 sets forth a section view of the present invention liquid applicator during the filling process.

FIG. 5 sets forth a section view of applicator 10 configured in the fully drawn position shown in FIG. 4. This position results from drawing plunger 13 outwardly from body 11 to its maximum withdrawn position.

More specifically, Applicator 10 includes an elongated cylindrical body defining a generally cylindrical reservoir 41 therein. Applicator 10 further includes an end cap 15 received upon one end of cylindrical body 11 in a press fit sealing attachment. End cap 15 further defines a center bore 60 extending therethrough. In addition, end cap 15 further defines a pair of extending tabs 62 and 63. Applicator 10 further includes a generally cylindrical piston 50 which is fitted within the interior reservoir of cylindrical body 11. Piston 50 includes a pair of tabs 52 and 53 extending toward end cap 15. Piston 50 further includes a threaded bore 54 together with an extending attachment prong 51. A resilient plunger 43 is positioned against piston 50 and includes an attachment cavity 46 configured to receive attachment prong 51 thereby securing plunger 43 against piston 50 for movement in either direction. Plunger 43 is preferably fabricated of a resilient sealing material such as resilient plastic or rubber and defines a pair of sealing ribs 44 and 45 which cooperate with the interior surface of reservoir 41 to provide liquid seal of plunger 43.

Applicator 10 further includes an agitator ball 42 which is freely movable within reservoir 41. Cylindrical body further defines a threaded end 40. Nib housing 20 preferably fabricated of a single molded component includes a generally cylindrical collar 21 having an internal thread which engages threaded end 40 of cylindrical body 11 thereby securing nib housing 20 to body 11. Nib housing 20 includes a valve body 22 defining a valve chamber 30 therein. A spring retainer 35 defining liquid passages 36 and 37 is supported within the interior of valve chamber 30. Valve chamber 30 further defines a tapered valve seat 31. Nib house 30 further includes a nib receiver 23 defining a nib bore 27. A valve seal 32 having a generally frusto-conical body is positioned against valve seat 31. Valve seal 32 further defines a receptacle 33. A compression spring 34 is received within receptacle 33 and spring retainer 35. Valve spring 34 provides a spring force which urges valve seal 32 against valve seat 31 maintaining a valve seal which inhibits fluid flow between nib bore 27 and valve chamber 30. A porous nib 25 fabricated of a suitable porous material defines an applicator end 24 extending from nib receiver 23 and an interior end 26 positioned against valve seal 32.

As can be seen in FIG. 5, plunger 13 is withdrawn cylindrical body 11 to its maximum withdrawn position in a manner which brings piston 50 into contact with end cap 15. It will also be noted that the drawing action resulting from moving piston 50 and plunger 43 toward end cap 15 produces a partial vacuum within reservoir 41. This partial vacuum is communicated through passages 36 and 37 to valve chamber 30. The drawing action of the partial vacuum within valve chamber 30 overcomes the force of valve spring 34 and causes valve seal 32 to be moved away from its sealing engagement with valve seat 31. As a result, liquid 70 is able to flow upwardly in the direction indicated by arrow 71 through nib bore 27. Additionally, the movement of valve seal 32 away from valve seat 31 allows further liquid flow past valve seal 32 in the manner indicated by arrows 72 and 73. Continuing the drawing action of plunger 43 and piston 50 draws a substantial quantity of liquid 70 into reservoir 41 until reservoir 41 is substantially filled with liquid 70. At this point, the filling of applicator 10 with liquid 70 is substantially complete. Agitator ball 42 is available for future use to allow the liquid within reservoir 41 to be agitated as applicator 10 is shaken.

Figure 6:
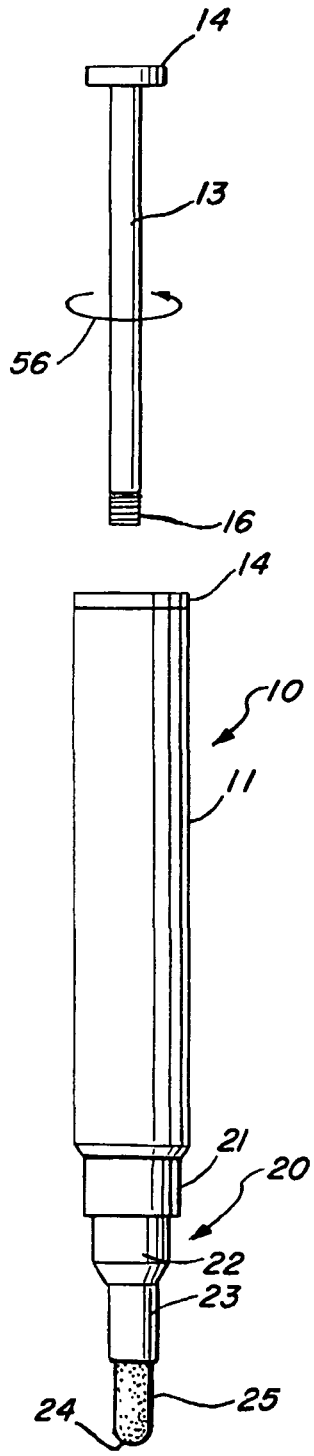
FIG. 6 sets forth the present invention liquid applicator following the filling process and having the plunger handle separated from the remainder of the liquid applicator.

FIG. 6 sets forth the present invention applicator following the liquid filling process shown in FIGS. 4 and 5 in which plunger handle 13 is removed from the remainder of applicator 10. This removal of plunger handle 13 from applicator 10 avoids the inconvenience and clumsiness which would otherwise result from the extension of plunger handle 13 following the filling process. The removal of plunger handle 13 from the remainder of applicator 10 is facilitated in the manner described below in FIG. 7 in greater detail. However, suffice it to note here that the removal process is provided to the user by simply twisting and rotating plunger handle 13 in the manner indicated by arrow 56.

Figure 7:
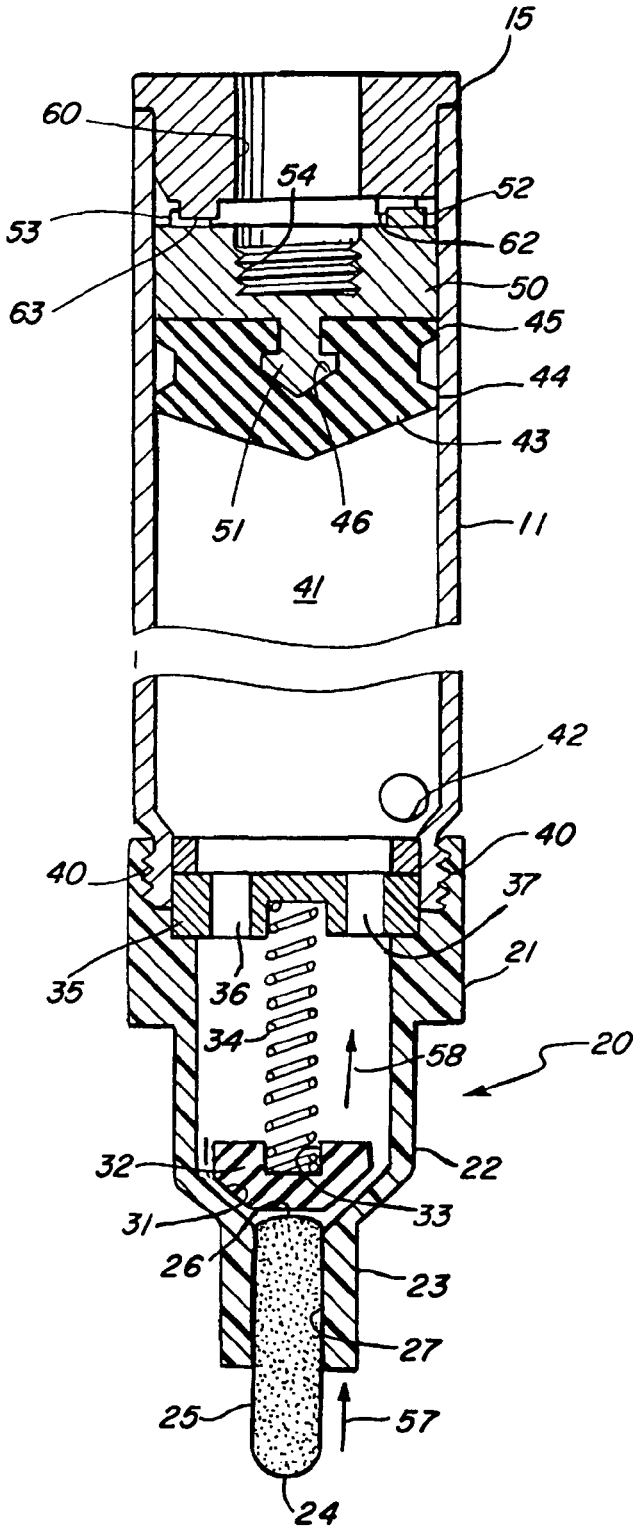
FIG. 7 sets forth a section view of the fully filled liquid applicator of the present invention prepared for use.

FIG. 7 sets forth a section view of applicator 10 following the liquid filling process set forth in FIGS. 4 and 5 and further following the removal of plunger handle 13 set forth and described in FIG. 6. The resulting configuration of applicator 10 provides a fully charged liquid fill figured for use in the above-described touch up and other liquid application processes much like the use of a conventional felt tip marker or the like.

More specifically, Applicator 10 includes an elongated cylindrical body defining a generally cylindrical reservoir 41 therein. Applicator 10 further includes an end cap 15 received upon one end of cylindrical body 11 in a press fit sealing attachment. End cap 15 further defines a center bore 60 extending therethrough. In addition, end cap 15 further defines a pair of extending tabs 62 and 63. Applicator 10 further includes a generally cylindrical piston 50 which is fitted within the interior reservoir of cylindrical body 11. Piston 50 includes a pair of tabs 52 and 53 extending toward end cap 15. Piston 50 further includes a threaded bore 54 together with an extending attachment prong 51. A resilient plunger 43 is positioned against piston 50 and includes an attachment cavity 46 configured to receive attachment prong 51 thereby securing plunger 43 against piston 50 for movement in either direction. Plunger 43 is preferably fabricated of a resilient sealing material such as resilient plastic or rubber and defines a pair of sealing ribs 44 and 45 which cooperate with the interior surface of reservoir 41 to provide liquid seal of plunger 43.

Applicator 10 further includes an agitator ball 42 which is freely movable within reservoir 41. Cylindrical body further defines a threaded end 40. Nib housing 20 preferably fabricated of a single molded component includes a generally cylindrical collar 21 having an internal thread which engages threaded end 40 of cylindrical body 11 thereby securing nib housing 20 to body 11. Nib housing 20 includes a valve body 22 defining a valve chamber 30 therein. A spring retainer 35 defining liquid passages 36 and 37 is supported within the interior of valve chamber 30. Valve chamber 30 further defines a tapered valve seat 31. Nib house 30 further includes a nib receiver 23 defining a nib bore 27. A valve seal 32 having a generally frusto-conical body is positioned against valve seat 31. Valve seal 32 further defines a receptacle 33. A compression spring 34 is received within receptacle 33 and spring retainer 35. Valve spring 34 provides a spring force which urges valve seal 32 against valve seat 31 maintaining a valve seal which inhibits fluid flow between nib bore 27 and valve chamber 30. A porous nib 25 fabricated of a suitable porous material defines an applicator end 24 extending from nib receiver 23 and an interior end 26 positioned against valve seal 32.

As mentioned above, plunger 13 is shown removed from the remainder of applicator 10. In accordance with an important aspect of the present invention structure, the engagement of tabs 52 and 53 of piston 50 and tabs 62 and 63 of end cap 15 facilitates the removal of threaded end 16 of plunger 13 (seen in FIG. 6) from its threaded engagement with threaded bore 54 of piston 50. This engagement of tabs 52 and 53 of piston 50 with tabs 62 and 63 of end cap 15 is required to provide a resisting force against piston 50 in its fully withdrawn position which in turn allows the removal of threaded end 16 of plunger 13 (seen in FIG. 6) from piston 50. Without this engagement, attempts to remove the threaded end of plunger 13 from piston 50 are difficult or unlikely due to the tendency of piston 50 to simply rotate as the user simply attempts to disengage the threaded attachment of plunger 13 within piston 50.

Thus, with applicator 10 configured in the manner shown in FIGS. 6 and 7 and with plunger 13 removed and presumably discarded, applicator 10 ready for use should the need arise.

Returning to FIG. 7, use of applicator 10 is carried forward in substantial accordance with conventional fabrication techniques utilized in liquid applicators. Specifically, the user is able to transfer a quantity of liquid from valve chamber 30 past valve seal 32 and into communication with porous nib 25 by simply pressing end 24 of nib 25 against a convenient surface. This pressure on nib 25 overcomes the force of valve spring 34 allowing nib 25 to move upwardly in the direction indicated by arrow 57. Interior end 26 of nib 25 is then forced against valve seal 32 overcoming the force of valve spring 34 and moving valve seal 32 away from valve seat 31 in the direction indicated by arrow 58. Once valve seal 32 is removed from valve seat 31, liquid within valve chamber 30 is able to flow between valve seal 32 and valve seat 31 into communication with porous nib 25. The wicking action of porous nib 25 carried the liquid down to end 24 for application to the desired surface. Once the transfer of liquid has been completed, the release of force against nib 25 allows valve spring 34 to return valve seal 32 into sealing engagement with valve seat 31 thereby preventing liquid flow. In this manner, cap 12 (seen in FIG. 1) may be returned to its attachment to nib housing 20 configuring applicator 10 for storage during periods of nonuse.

What has been shown is a porous liquid tip applicator having a draw fill mechanism which facilitates a quantity of liquid within the applicator for future use. The applicator following the liquid filling process is then configured by removal of the plunger handle used during filling to avoid the awkwardness which would otherwise result.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A porous tip liquid applicator comprising:

a body defining opposed ends and an interior reservoir;

an end cap secured to one end of said body defining a bore therethrough;

a nib housing secured to the remaining end of said body having a porous nib supported therein in communication with said reservoir;

a plunger moveable within said reservoir, said plunger including a resilient plunger seal, a piston and attachment means for securing said resilient plunger seal to said piston;

means for coupling operative between said end cap and said piston when said piston is drawn against said end cap to inhibit rotation of said piston; and a plunger handle extending through said end cap bore into said reservoir, said plunger and said plunger handle including threaded engagement means for removable engagement and disengagement therebetween whereby said plunger handle removably engages said plunger to permit drawing liquid into said reservoir by drawing said plunger handle away from said nib housing to bring said piston against said end cap and whereby said plunger handle may be disengaged from said plunger by rotation and removed once liquid drawing is completed and whereby said plunger and said resilient plunger seal maintain a seal of said interior reservoir captivating liquid therein after said plunger handle is disengaged from said plunger and removed from said applicator.

2. The liquid applicator set forth in claim 1 wherein said engagement means includes a threaded bore and a cooperating threaded end for providing a removable threaded attachment between said piston and said plunger shaft.

3. The liquid applicator set forth in claim 2 wherein said threaded bore is formed in said piston and said threaded end is formed on said plunger shaft.

4. The liquid applicator set forth in claim 3 wherein said coupling means includes at least one tab extending from said end cap toward said piston and at least one tab extending from said piston toward said end cap, said tabs aligned to engage each other.

5. The liquid applicator set forth in claim 4 wherein said nib housing includes:

a valve chamber in liquid communication with said interior reservoir;

a nib bore in fluid communication with said valve chamber;

a porous nib partially received within said nib bore in a removable attachment; and a valve controlling liquid flow between said valve chamber and said porous nib, said nib being removable to enhance liquid flow through said nib bore during liquid drawing.

6. A liquid applicator comprising:

an elongated body defining first and second ends, a reservoir wall therebetween and a liquid reservoir therein;

an end cap secured to said first end having an end cap bore extending therethrough and at least one end cap tab ;

a plunger handle passing through said end cap bore and having a first end within said reservoir and a second end outside said reservoir;

a piston having at least one piston tab, said piston fitted to said reservoir wall and removably attached to said first end of said plunger handle and supporting a plunger seal which sealingly contacts said reservoir wall to seal said reservoir;

a nib housing secured to said second end of said elongated body having a porous nib extending from said nib housing; and a valve providing controllable liquid communication between said porous nib and said reservoir, said plunger handle extending into said elongated body to position said piston and said plunger seal proximate said nib housing and thereafter being movable to move said piston to said end cap to draw liquid into said reservoir and position said piston tab and said end cap tab into engagement after which said plunger handle is removed from attachment to said piston and withdrawn from said elongated body and said end cap and said plunger seal and said piston maintain said seal of said reservoir with said plunger handle removed.

7. The liquid applicator set forth in claim 6 wherein said nib is removable from said nib housing to enhance liquid flow into said reservoir.

8. The liquid applicator set forth in claim 7 wherein said valve includes a valve spring urging said valve toward a closed position and is drawn open when said plunger handle is moved to draw liquid into said reservoir.

9. The liquid applicator set forth in claim 8 wherein said valve includes a resilient valve seal coupled to said valve spring.

10. A liquid applicator having a body supporting a porous nib, an end cap having an end cap bore, an internal liquid reservoir, a piston sealingly cooperating with said reservoir and movable within said reservoir to draw liquid into said reservoir and a plunger shaft extending through said end cap bore into said reservoir having a removable attachment to said piston; and a lock formed of cooperating members on said end cap and said piston, said plunger handle being operable to move said piston so as to draw a quantity of liquid into said reservoir and thereafter being removed once the reservoir is at least partially filled with liquid and said piston maintaining its closure and seal of said reservoir after said plunger handle is removed to captivate said quantity of liquid within said reservoir.

* * * * *